United States Patent [19]

Melotti

[11] 4,228,615

[45] Oct. 21, 1980

[54] SMALL-SIZE TOY ANIMAL HAVING ARTICULATED LIMBS

[76] Inventor: Athos Melotti, Via Dello Spalto, 3, Bologna, Italy

[21] Appl. No.: 939,717

[22] Filed: Sep. 5, 1978

[30] Foreign Application Priority Data

Sep. 15, 1977 [IT] Italy ..... 4880/77[U]

[51] Int. Cl.[3] ..... A63H 11/00; A63H 33/00; A63H 3/20; A63H 3/46

[52] U.S. Cl. ..... 46/22; 46/127; 46/161; 46/173

[58] Field of Search ..... 46/161, 22, 173, 127, 46/25, 28, 16, 17, 23, 24, 26, 27, 29, 30, 31

[56] References Cited

U.S. PATENT DOCUMENTS

| | | | |
|---|---|---|---|
| 1,777,948 | 10/1930 | Van Eerde | 46/161 |
| 2,959,888 | 11/1960 | Noble | 46/28 |
| 3,952,449 | 4/1976 | Terzian | 46/161 |
| 4,044,498 | 8/1977 | Rahmstorf | 46/22 |

*Primary Examiner*—Russell R. Kinsey
*Assistant Examiner*—Michael J. Foycik, Jr.
*Attorney, Agent, or Firm*—Guido Modiano; Albert Josif

[57] ABSTRACT

An articulated-limb toy animal has a pair of front limbs and a pair of hind limbs articulated to the trunk of the toy animal. In each limb pair, the limbs are joined to each other by a respective horizontal axis cylindrical stem and the trunk is provided at the front and hind portions thereof with seats for a pivotal engagement with the stems.

2 Claims, 3 Drawing Figures

SMALL-SIZE TOY ANIMAL HAVING ARTICULATED LIMBS

BACKGROUND OF THE INVENTION

This invention relates to a small-size toy animal having articulated limbs.

It is a well known fact that toy soldiers are still very popular with today's children. To increase the authenticity of such toy or puppet soldiers, provision has been made in some instance for conferring mobility to parts of the toy soldier and for permitting attachment and removal of accessory parts to and from it. In particular, small-size toy horses arc currently marketed which may be ridden by a toy soldier. In some cases, the toy horse is provided with limbs which are independent and articulated to its trunk or body, so that it is made up of several parts, thereby its manufacturing and assembling becomes a costly and complex procedure.

SUMMARY OF THE INVENTION

This invention sets out to provide a small-size toy animal, or puppet animal, which additionally to affording articulation for both its front and hind limbs, and its head, with respect to the trunk, also allows for partial movement of each leg relative to its paired one.

Within that general object, the invention is directed to providing a toy animal which, while capable of preforming as mentioned above, is also simple and advantageous to manufacture and assemble.

Such objects are achieved by an articulated limb toy animal according to this invention being characterized in that it comprises a pair of front limbs and a pair of hind limbs articulated to a trunk of the toy animal, and in that in each said limb pairs said limbs are joined to each other by a horizontal axis cylindrical stem adapted for articulation with said trunk of the toy animal, said trunk being provided at the front and hind portions thereof with seats for pivotal engagement with said stems, a suitable cutout being provided for insertion of said stem into a respective one of said seats, the front limb stem further engaging a head piece for the toy animal, said head piece being provided at the bottom with a similar engagement seat.

BRIEF DESCRIPTION OF THE DRAWINGS

The invention details will become more apparent from the following description of a preferred embodiment of this toy animal with articulated limbs, as illustrated by way of example in the accompanying drawing, where.

DESCRIPTION OF THE PREFERRED EMBODIMENTS

Figure 3:
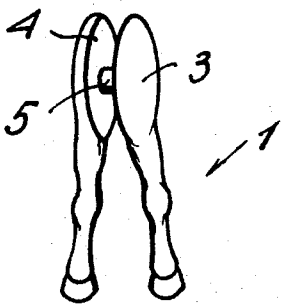
FIG. 3 is a perspective view of a limb pair of the small horse.
Figure 1:
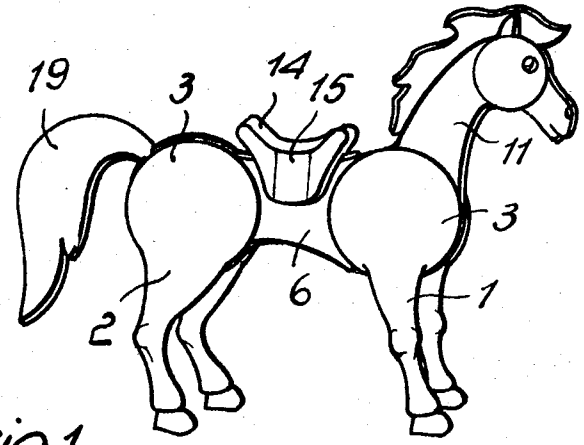
FIG. 1 is a side view of a toy animal representing a small horse.
Figure 2:
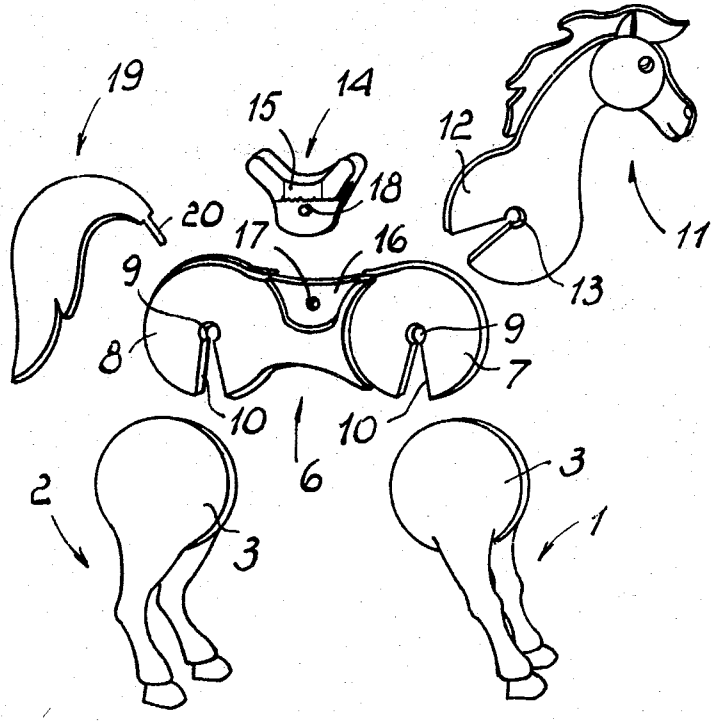
FIG. 2 is an exploded and partly cut away view thereof.

Making reference to the drawing figures, this toy horse comprises a pair of front limbs, generally indicated at 1, and a pair of hind limbs, indicated at 2. Such limbs, partly suggested only, are molded from a plastic material, similarly to the other members to be described hereinafter.

The limbs 1 and 2 define at their tops a shoulder or hip portion 3 of circular shape which is formed on its inner side with a flat face 4.

The limbs of each pair are joined to each other by means of a cylindrical stem or pin 5 having its axis centrally perpendicular to the plane of said shoulders or hips 3, wherefor it serves as an articulation pivot pin.

The front limbs 1 and hind limbs 2 can be assembled to a trunk 6, of flattened shape in a vertical plane, defined by a front circular portion 7 and a rear circular portion 8, suitably radiused, which have diameters equal to those of the shoulders or hips 3. At the center of such circular portions 7 and 8 of the trunk 6, there is formed a respective hole 9 adapted to provide an engagement or coupling seat for the stems 5 of the limbs 1 and 2, for the press fitting of which a suitable radial cutout 10 is provided, the cutout tapering at the hole 9 therefrom it diverges.

The circular portion 7 of the trunk 6 has a thickness dimension on which is one half the thickness of the rear one 8. This allows for the mounting, onto the stem 5 belonging to the front limbs 1, of a head piece 11 of the toy horse, defining at the base of the neck a like circular portion 12 which is provided with a related hole 13 for coupling with the stem as well as with the respective radial cutout.

Moreover, to the trunk 6 a saddle 14 can be mounted, being configurated as a yoke and provided on both sides with a groove 15 for insertion therein of a toy human figure or soldier. For the mounting of the saddle 14, the trunk 6 is formed, at an upper middle location and on both faces, with a recess 16 of suitable shape, which has a central through hole 17 for engagement with a pair of pins 18 formed coaxially on the respective inner faces of the saddle 14.

Finally, a tail piece 19 can be inserted in the trunk 6 of the toy horse wich is provided with a pin 20 adapted for insertion in a suitable hole formed in the rear circular portion 8 of the trunk and not visible in the drawing figures.

This toy horse operates as follows. The front limbs 1 and rear limbs 2 are mounted to the trunk 6 by press fitting the respective stems 5 into the holes 9 through the cutouts 10. Then, the head 11 of the horse is similarly assembled to the stem 5 of the front limbs 1.

In an analogous way the tail piece 19 is snap fitted to the trunk 6.

Upon completion of the assembling step, said limbs and head become articulated to the trunk, thus affording a very large number of different positions or settings to suit any playing requirements.

The particular joining arrangement of the limbs together, through the stem 5, further permits movement of one limb with respect to the other adjacent limb, by twisting the stem itself, as allowed by the elasticity of the material from which the toy horse is made. Furthermore, it is possible to have such limbs, rather than joined together, molded separately and connected to each other in a pivotal manner, e.g. through the stem 5. Thus, a still wider range of movements can be ensured between one limb and its paired one. The friction between the flat faces 4 of the limbs 1 and 2 against the respective circular portions 7 and 8 of the trunk 6 is sufficient to maintain such paired limbs divergent, as intended.

Lastly, it should be noted that the various components can be quickly assembled and disassembled, including the tail piece. Obviously, this toy animal could be a reproduction of an animal other than a horse, such as a cow, pig, lion, tiger, panther, etc.

I claim:

1. An articulated limb toy animal, comprising a pair of front limbs and a pair of hind limbs articulated to a trunk of the toy animal, in each said limb pairs said limbs being joined to each other by a horizontal axis cylindrical stem adapted for articulation with said trunk of the toy animal, said trunk having at the front and hind portions thereof seats for pivotal engagement with said stems, a suitable cutout for insertion of said stem into a respective one of said seats, the front limb stem further engaging a head piece for the toy animal, said head piece having at the bottom a similar engagement seat and wherein said trunk defines a front and a rear circular portions, suitably radiused, having a flattened shape in a vertical plane, and formed with a respective central hole adapted to act as said pivotal engagement seat for said stems of the toy animal limbs, said stems entering by press fit said holes through respective cutouts radially extending with respect to said portions.

2. A toy animal according to claim 1, wherein in place thereof said front circular portion of the trunk has a thickness dimension which is one half the thickness of said rear circular portion, such as to allow for the mounting onto said stem of the front limbs and head piece of the toy animal, said head piece having at the base of the neck a like circular portion.

* * * * *